United States Patent [19]

Osawa

[11] Patent Number: 4,669,452

[45] Date of Patent: Jun. 2, 1987

[54] ELECTRIC VIBRATOR

[75] Inventor: Mitsuyoshi Osawa, Gunma, Japan

[73] Assignee: Ichikawa Press Industry Co., Ltd., Japan

[21] Appl. No.: 724,289

[22] Filed: Apr. 17, 1985

[30] Foreign Application Priority Data

Jul. 30, 1984 [JP] Japan ..... 59-116886[U]

[51] Int. Cl.[4] ..... A61H 1/00

[52] U.S. Cl. ..... 128/36; 128/32

[58] Field of Search ..... 128/31, 32, 36, 67, 128/34, 35, 41, 44, 37; D24/36

[56] References Cited

U.S. PATENT DOCUMENTS

| | | | |
|---|---|---|---|
| 2,096,646 | 10/1937 | Thornton-Norris | 128/41 |
| 2,412,093 | 12/1946 | Mininberg | 128/36 |
| 2,422,639 | 6/1947 | Wenander | 128/36 |
| 2,489,582 | 11/1949 | McCready | 128/36 |
| 3,115,139 | 12/1963 | Schneider | 128/32 |
| 3,451,391 | 6/1969 | Tavel | 128/36 |
| 3,585,990 | 6/1971 | Blechly et al. | 128/36 |
| 3,830,232 | 8/1974 | McNair | 128/41 |
| 3,991,751 | 11/1976 | O'Rourke | 128/36 |
| 4,033,338 | 7/1977 | Igwebike | 128/36 |

FOREIGN PATENT DOCUMENTS

| | | | |
|---|---|---|---|
| 909768 | 3/1954 | Fed. Rep. of Germany | 128/67 |
| 2205031 | 8/1973 | Fed. Rep. of Germany | 128/36 |

*Primary Examiner*—Charles A. Pearson
*Assistant Examiner*—Tonya Eckstine
*Attorney, Agent, or Firm*—Lowe, Price, Leblanc, Becker & Shur

[57] ABSTRACT

A grip and an arm orthogonal to each other are rotatably connected to be folded together. The grip accommodates dry cells. A plurality of projections for massaging are formed on the lower surface of the free end of the arm. An interior vibration device is provided in the free end of the arm. In use, the grip and the arm are extended orthogonally at the connection portion. When the projections are pressed against sore muscles, a temporary holding stopper retracts allowing a contact spring to close to operate the vibrator. Vibration is transmitted to the muscles through the projections.

4 Claims, 5 Drawing Figures

FIG. 2
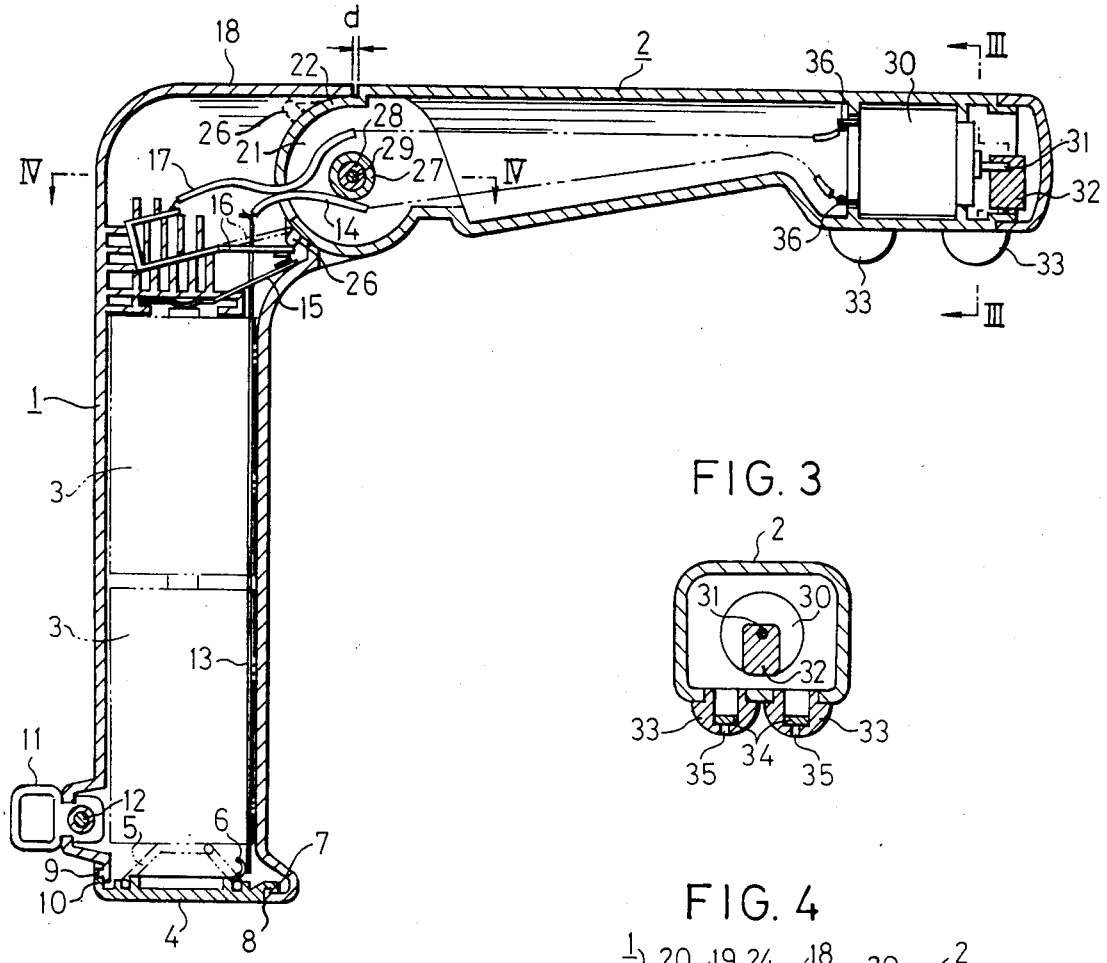
FIG. 3
FIG. 4
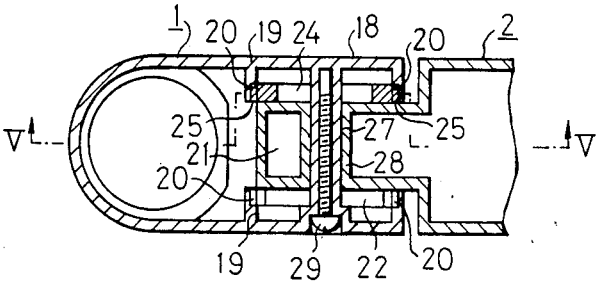

ELECTRIC VIBRATOR

BACKGROUND OF THE INVENTION

The present invention relates to a small portable vibrator which can be folded and driven by electric dry cells.

Conventionally, the portable vibrator has been comprised of the grip accommodating dry cells, and an arm provided with projections and orthogonal to the grip.

The conventional vibrator comprising the grip and arm is bulky and inconvenient. The vibrator in which the vibration device operates when a switch provided in the grip is switched on, takes an unnecessary long time to operate, rapidly exhausting the dry cells.

BRIEF SUMMARY OF THE INVENTION

An object of the present invention is to provide a vibrator of small size with a foldable grip and arm.

To achieve the object, the grip and the arm are coupled freely rotatably at the connecting portion.

Another object of the present invention is to provide a vibrator wherein the device is actuated when the projections of the arm are pressed on the diseased part with a pressure higher than the predetermined pressure, closing two contact springs for operating the vibration device without unnecessarily consuming the dry cells.

For achieving the object described above, the connection part of the grip and the arm are provided with a temporary holding stopper which comes slightly off when the affected part pressing projections are pressed on the diseased part and a operating projection piece which closes the contact spring for the vibration device according to a slight rotational movement of the arm during the time of pressing.

Objects described above and other objects and advantages of the present invention will be apparent from the following description taken in conjunction with the accompaning drawings.

BRIEF DESCRIPTION OF THE DRAWINGS

FIG. 2 is a longitudinal section through the vibrator of FIG. 1;

FIG. 3 is a section taken along the line III—III of FIG. 2;

FIG. 4 is a section taken along the line IV—IV of FIG. 2; and

DETAILED DESCRIPTION

Figure 1:
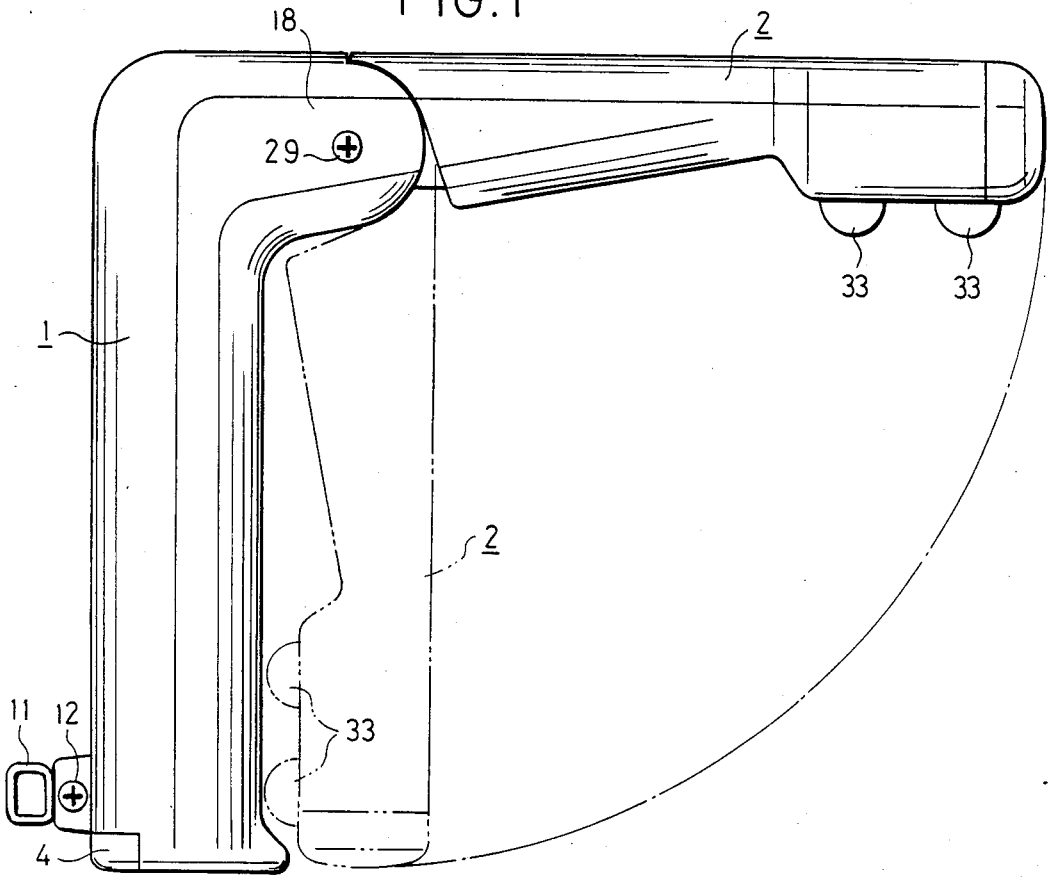
FIG. 1 is a front view of an embodiment of a portable electric vibrator according to the present invention.
Figure 5:
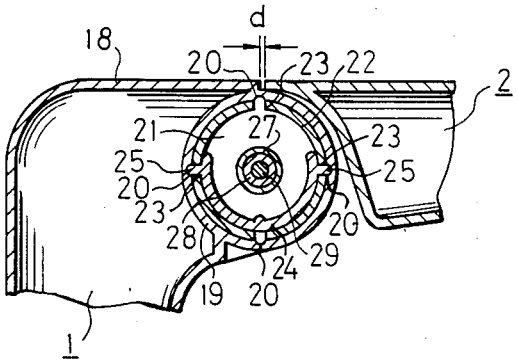
FIG. 5 is a section taken along the line V—V of FIG. 4.

An embodiment of the vibrator according to the present invention will be described according to the accompanied drawings.

Referring to the drawings, (1) designates a grip and (2) designates an arm.

Said grip (1) has its left side in the drawings made in a form of an arc and its right side made in a form of a flat hollow cylinder into which two dry cells (3) are inserted in series from the opening at the lower end. A cap (4) covering the opening is provided with a coil spring (5) to prevent disconnection of the cells and also includes a ground plate (6). If the cap (4) is pressed inward, causing stopper portions (7) and (8) to disengage, and then pushed to the left in the drawing while the cap is pressed, a projection (9) and an engaging hole (10) disengage. For insertion, the reverse operation is performed.

A hanger (11) is fixed to the outer side of the lower part of grip (1) with a screw (12). A ground plate (13) extends upward in the interior of grip (1), having its upper end connected with a lead wire (14). Contact springs (15) and (16) (e.g. leaf springs) are arranged opposite each other with a slight gap therebetween. One end of spring (15) contacts with the positive pole of the dry cell and one end of the other contact spring (16) is connected to a lead wire (17).

The upper end portion of grip (1) and the coupling member (18) bent in a right angle are integral. On the inside of the coupling member (18), a ring shaped projection (19) is formed (FIGS. (4) and (5)). On the inner circumferential wall of projection (19), engaging detents (20) are formed at angular intervals of 90 degrees.

A cylindrical coupling member (21) is provided at the left end of arm (2) as shown in FIG. 2. On coupling member (21), outer ring shaped projections (22) are formed for engagement with ring shaped projections of grip (1) as shown in FIGS. (4) and (5). The ring shaped projection is provided with holes (23) at intervals of 90 degrees. On the inside of the projection (22), a temporary holding stopper (24) is provided in the form of resilient ring, having its projections (25) coupled with engaging detents through penetrated holes (23). In the state described above, a slight gap (d) is formed on the upper part of coupling members (18) and (21) of grip (1) and arm (2) respectively. Further, on the outer circumference of the coupling member (21) of the arm, an operational projection piece (26) is provided for pressing contact spring (16). At the center of coupling members (18) and (21) of grip (1) and arm (2), axis (28) of the grip (1) is fitted freely rotatably into a fitting hole (27) of the arm (2). Ordinarily, in case of the plastic moulding of the grip (1) and the arm (2), one moulded in two parts is fixed by a tapping screw (29). A rotation axis (31) of a motor (30) fitted on the inside of said arm (2) is fixed at the eccentric position of a balance weight (32). Four pressing projections (33) are provided on the lower surface of the end of the arm (2). The interior of the projection (33) has a disc magnet (34) with a small hole at the center for promoting the cure. Terminals (36) of said motor (30) are connected to other ends of lead wires (14) and (17).

When the vibrator is not used, the arm is folded in two at the coupling members (18) and (21) as shown by a chain line. At this time, projections (25) of the temporary holding stopper (24) are fitted to engaging detents (20) for holding the folding state with stability.

When the vibrator is used, the arm (2) is rotated with coupling members (18) and (21) as the center. Then, the temporarily holding stopper (24) comes off once from engaging detents (20), sliding on the inside of the ring shaped projection (19), and being fitted to the neighboring engaging dent (20) after the rotation of 90 degrees. The operational projection piece (26) on the outer circumference presses the contact spring (26) to the neighboring position of other contact spring (15). At the moment, these two springs (16) and (15) are not connected.

When the folded grip (1) and arm (2) are brought orthogonal to each other and projections (33) at the end of the arm are pressed to the diseased part with a pressure larger than the predetermined value, the temporarily holding stopper (24) goes upward a little from the engaging detents (20), and the arm (2) rotates to the position where the gap (d) of the upper end becomes null. Contact springs (16) and (15) are connected being pressed by the operational projection piece (26) for operating the motor (30). With the operation of the motor (30), the eccentric weight (32) is caused to translate, and vibration is generated at the arm (2). The vibration is transmitted to the muscles through projections for loosening stiffness.

When projections (33) is removed from the diseased part, projections (25) of the temporarily holding stopper (24) are fitted into engaging detent (20) again by the elasticity of the temporarily holding stopper (24), the arm (2) being brought back a little to the original position, contact springs (16) and (15) being separated from each other, the motor (30) being stopped, and the vibration is brought to a stop.

The vibrator as described above is not bulky and very convenient to carry when the grip and the arm are folded in two in case of being not used on carrying.

What is claimed is:

1. A portable electric vibrator, comprising a grip and an arm connected to extend between a folded position and an operating position wherein the grip and arm are generally orthogonal to each other, said grip adapted to contain dry cells in its interior, a plurality of pressing projections formed on a lower surface at a free end of said arm, a vibration device contained in the free end portion of said arm, said grip and said arm being connected freely rotatably at a connecting portion of said grip and said arm so that said grip and said arm can be folded together, a temporary holding stopper maintaining the connecting portion of said grip and said arm in predetermined angular relationship to each other when the vibrator is used, contact spring means provided adjacent the stopper and operational projection piece means adjacent said stopper, said operational projection piece means being movable when the pressing projections are pressed against muscles and the like to actuate the vibration device by moving said contact spring means into contact with each other via slight rotation of said arm caused by the pressing projections pressed against muscles and the like.

2. A portable electric vibrator in accordance with claim 1, wherein the vibration device comprises a motor and a weight provided in an eccentric state on the rotation axis of said motor.

3. The portable electric vibrator of claim 1, wherein said temporary holding stopper is located in the connecting portion of said grip and said arm.

4. The portable electric vibrator of claim 3, wherein said temporary holding stopper is adapted to maintain a slight gap between upper adjacent surface portions of said grip and arm when the arm is initially rotated into generally orthogonal relation to the arm , said connecting portion further including a coupling member connected to said projection piece means, whereby contact of said pressing projections with muscles and the like causes said arm to rotate slightly about a pivot axis in the connecting portion to close said gap and cause movement of the temporary holding stopper enabling said projection piece means to press the contact spring means together actuating said vibration device, said contact spring means including a pair of springs mounted in the grip adjacent the temporary holding stopper.

* * * * *